US005165866A

United States Patent [19]

Kato

[11] Patent Number: 5,165,866

[45] Date of Patent: Nov. 24, 1992

[54] BELLOWS PUMP

[75] Inventor: Masayuki Kato, Higashimatsuyama, Japan

[73] Assignee: Iwaki Co., Ltd., Tokyo, Japan

[21] Appl. No.: 802,037

[22] Filed: Dec. 3, 1991

[30] Foreign Application Priority Data

Dec. 7, 1990 [JP] Japan ..... 2-402121[U]
Dec. 7, 1990 [JP] Japan ..... 2-402122[U]

[51] Int. Cl.[5] ..... F04B 17/00; F04B 35/00
[52] U.S. Cl. ..... 417/360; 417/372
[58] Field of Search ..... 417/360, 372, 373; 92/34

[56] References Cited

U.S. PATENT DOCUMENTS 2,553,247 5/1951 Fowler ..... 417/473
4,457,672 7/1984 Ogura et al. ..... 417/360

*Primary Examiner*—Richard A. Bertsch
*Assistant Examiner*—Alfred Basichas
*Attorney, Agent, or Firm*—Jones, Tullar & Cooper

[57] ABSTRACT

In a bellows pump, a bellows is vertically located and has an upper and a lower end sections. The upper end section is inserted in a mounting through hole of an upper frame portion. It is detachably mounted in the frame portion by engagement between projections and communicates with a pump head. The lower end section is detachably mounted by engagement between projections in an upper connecting end portion of a reciprocating member. A torque from a motor is received by a motion conversion mechanism including an eccentric cam member and a reciprocating member, and causes elongation and contraction of the bellows in vertical direction. A motor shaft is loosely engaged with the eccentric cam member, which is supported by a pin shaft and extends along a horizontal axis of the motor shaft.

8 Claims, 4 Drawing Sheets

BELLOWS PUMP

BACKGROUND OF THE INVENTION

This invention relates to a bellows pump, which comprises a vertically disposed bellows and a pump head thereabove, the bellows being coupled to a motion conversion mechanism including an eccentric cam member driven by a motor for elongation and contraction along a vertical axis to effect pumping.

In a bellows pump, in a frame is provided a pump head having an inlet port and a discharge port, and also a conversion mechanism is provided, which operates to convert a rotational motion to a reciprocal motion and comprises, for instance, an eccentric cam member driven for rotation by a drive motor and a reciprocating member coupled to the excentric cam member. A bellows is vertically disposed between the pump head and conversion mechanism with an upper end section of the bellows mounted on a frame and communicated with the pump head and a lower end section of the bellows mounted in an upper connecting end portion of a reciprocating member coupled to the eccentric cam member constituting the motion conversion mechanism. With the operation of the motion conversion mechanism, the bellows is elongated and contracted to effect pumping.

In a well-known structure for mounting the bellows, the bellows is fixedly secured by a turn-buckle type mounting means, which is provided with a female thread member located at a communication hole of the pump head and screwed onto the upper end section of the bellows through a cap member and with an end cap member screwedly coupled to the lower end section of the bellows and the upper connecting portion of the reciprocating member.

In the above prior art bellows pump, the bellows is screwedly secured, and two separate parts, i.e., the cap member and end cap member, are required. Therefore, the operation of assembling the component parts requires an increased number of steps. Particularly, the operation of mounting the bellows in a limited narrow space presents problems in that it is not easy and takes considerable time.

Further, in the prior art bellows pump, the motor shaft support structure supports an eccentric cam member driven for rotation by the drive motor. In one of such well-known structures, the motor shaft of the drive motor is secured by set screws or the like to the eccentric cam member on one side thereof, and the cam member is driven for rotation by the sole motor, that is, the motor shaft is support for rotation in a bearing provided in a motor housing. In another structure, the motor shaft is fitted in and penetrates the eccentric cam member, and its free end projecting therefrom is supported for rotation on the frame on the other side of the eccentric cam member. In a further structure, not only a stem portion but also a free end portion of the motor shaft is supported for rotation on a frame.

The above prior art bellows pumps have problems. More specifically, where the eccentric cam member is supported for rotation by the sole motor, a load accompanying the elongation and contraction of the bellows in the vertical direction of elongation and contraction of the bellows perpendicular to the horizontal axial direction of the eccentric cam member, i.e., commonly called overhang load, is applied to the motor shaft via the eccentric cam member. This overhand load produces a stress in the entire motor shaft; particularly it produces a great stress in a portion of the motor shaft corresponding to a bearing provided in a motor housing.

Where the free end portion of the motor shaft is supported for rotation in a frame, the stress produced in the motor shaft due to overhand load is reduced compared to the above structure. This structure, however, is insufficient to solve the structure.

The structure in which not only the free end but also the stem of the motor shaft is supplied for rotation in a frame, can suppress stress in the portion of the motor shaft corresponding to the bearing provided in the motor housing. In this respect, it can solve the problem. In this case, however, the motor shaft has to be supported at two positions in the frame. This leads to an increase of the manufacturing cost. In addition, since the motor shaft should be long and penetrate the eccentric cam member, the operation of assembling the individual constituent parts is cumbersome.

SUMMARY OF THE INVENTION

The present invention has been intended in the light of the above problems, and it is an object of the invention to provide a bellows pump, which permits a bellows-mounting operation to be carried out easily and quickly even in the limited narrow space, permitting ready and quick operation of assembling the bellows with the corresponding parts.

Another object of the invention is to provide a bellows pump, which permits an eccentric cam member to be supported for rotation such as to prevent a load accompanying the elongation and contraction of the bellows in the directions of elongation and contraction of the bellows perpendicular to the axial direction of the eccentric cam member from being applied to the motor shaft via the eccentric cam member and also be supported at a single position, as well as permitting durability improvement and manufacturing cost reduction and also permitting ready and quick operation of assembling the eccentric cam member with the corresponding parts.

To attain the above objects of the invention, there is provided a bellows pump, which comprises: a pump frame; a pump head mounted on an upper frame portion of the pump frame and having an inlet port, a discharge port and a flow path for pumping fluid communicating with the inlet and discharge ports via respective valves; a drive motor mounted on the pump frame; a drive shaft driven by the drive motor; an eccentric cam member for producing eccentric rotation with the rotation of the drive shaft; a reciprocating member having a connecting end portion for producing a vertical reciprocal motion with the eccentric rotation of the eccentric cam member; a bellows disposed vertically in the pump frame and having a lower and an upper end section, the bellows being capable of being elongated and contacted along a vertical line, the upper end section having a communication hole communicating with the inside of the bellows with the flow path of the pump head; first mounting means for connecting the upper end section of the bellows to the pump head; and second mounting means for connecting the lower end of the receprocating member.

The above first mounting means includes a first projection formed on and along a circumferential region of the outer periphery of the upper end section of the bellows, a first notch formed in the remaining circumferential region of the outer periphery, a mounting hole penetrating the upper frame portion of the pump frame and permitting insertion of the upper end section of the bellows, a second projection formed on and along a circumferential region of the inner periphery of the mounting hole and a second notch formed in the remaining circumferential region of the inner periphery, the bellows being capable of being rotated with the upper end section of it inserted in the mounting hole about the vertical axis between a first engagement position, at which the first and second projection engage each other, and a flat non-engagement position, at which the first projection face the second notch, the upper end section being fixedly mounted in the upper frame portion of the pump frame when the bellows is at the first engagement position, the upper end section being capable of being removed from the upper frame portion of the pump frame when the bellows is at the first non-engagement position.

The second mounting means includes a third projection formed on and along a circumferential region of the outer periphery of the lower end section of the bellows, a third notch formed in the remaining circumferential region of the outer periphery, a recess formed in the connecting end portion of the reciprocating member and capable of receiving the lower end portion of the bellows, a fourth projection formed on and along a circumferential region of the inner periphery of the recess, a fourth notch formed in the remaining region of the inner periphery, the bellows being capable of being rotated with the lower end section of it inserted in the recess about the vertical axis between a second engagement position, at which the third and fourth projections engage with each other, and at a second non-engagement position, at which the third projection faces the fourth notch, the lower end section being fixedly mounted on the connecting end portion of the reciprocating member when the bellows is at the second engagement position, the lower end section being capable of being removed from the connecting section when the bellows is at the second non-engagement position, at least one of the first and second mounting means being provided with stop means for restricting the rotation of the bellows about the vertical axis.

In a preferred arrangement, the stop means is a stopper provided such that it is continuous to one end of the fourth projection in the circumferential direction thereof.

In another preferred arrangement, the upper end section of the bellows has an upper end edge around the communication hole, and the upper end edge is in contact via seal means with the corresponding end face of the pump head, thereby ensuring reliable holding between the upper end section and the upper frame portion when the bellows is at the first engagement position.

In a further preferred arrangement, the lower end section of the bellows has a closed end surface, and the recess of the reciprocating member has a bottom surface, and the closed end surface being in contact with the bottom surface with the bellows at the second engagement position, thereby ensuring reliable holding between the end section and the reciprocating member with the bellows at the second engagement position.

With the bellows pump according to the invention as described above, the bellows can be detachably mounted by both end sections thereof to the corresponding upper frame and the sections connecting the end section of the reciprocating member through first and second mounting means and then turning it until it is restricted by the stopper, i.e., until both the end sections are brought to their predetermined proper engagement position. Also, it can be readily removed by turning it reversely such that both the end sections are turned from the engagement position to the non-engagement position. Since the first and second mounting means do not require additional parts, such as cap member and end cap member as in the prior art bellows pump, the number of parts which have to be assembled for mounting the bellows can be reduced to permit reduction of the number of steps and cost of the assembling operation. In addition, the bellows can be mounted and removed easily and quickly in the limited narrow space.

In a further arrangement, the drive shaft consists of a motor shaft extending in a horizontal direction from the drive motor to the eccentric cam member and having a horizontal axis of rotation, and the bellows pump further comprises loose coupling means for causing rotation of the extended end portion of the motor shaft and the eccentric cam member in unison with each other in the direction of rotation while permitting slight relative movement of the two in lateral direction with respect to the horizontal axis of rotation, a pin shaft having a stem portion fixed to a support frame portion of the pump frame and horizontally extending to an extended end portion of the motor shaft in a state aligned to the horizontal axis of rotation, and a support hole formed in the eccentric cam member for receiving the pin shaft to permit rotation of the eccentric cam member about the pin shaft. In a further preferred arrangement, said loose coupling means includes an insertion hole formed in the eccentric cam member and receiving the extended end portion of the motor shaft, an engagement pin radially projecting from the extended end portion, and an engagement groove formed in the peripheral wall of the insertion hole in the eccentric cam member for engagement with the engagement pin, the inner diameter of the insertion hole being greater than the outer diameter of the extended end portion of the motor shaft.

In a further arrangement, the support frame portion is made of a moldable synthetic resin, the pin shaft is made of a metal, and the pin shaft is fixed to the support frame portion by insert molding.

With the bellows pump according to the invention described above, the load accompanying the elongation and contraction of the bellows in the vertical directions of the elongation and contraction of the bellows perpendicular to the horizontal direction of the axis of the eccentric cam member, i.e., commonly called overhand load, is received by the pin shaft to suppress overhang load that may otherwise be applied to the motor shaft, and also the eccentric cam member may be supported for rotation at a single position, thus permitting durability improvement and manufacturing cost reduction. Further, the structure, in which the pin shaft and motor shaft are provided separately on the respective sides of the eccentric cam member, and the structure, which does not require any set screw for securing the motor shaft to the eccentric cam member, permits ready and quick operations of assembling and disassembling the individual constituent parts and improvement of the operation control property.

BRIEF DESCRIPTION OF THE DRAWINGS

The above and other objects, features and advantages of the present invention will become more apparent from reading the following detailed description of a preferred embodiment of the invention, when considered in connection with the accompanying drawings, in which.

DETAILED DESCRIPTION OF THE PREFERRED EMBODIMENT

Figure 1:
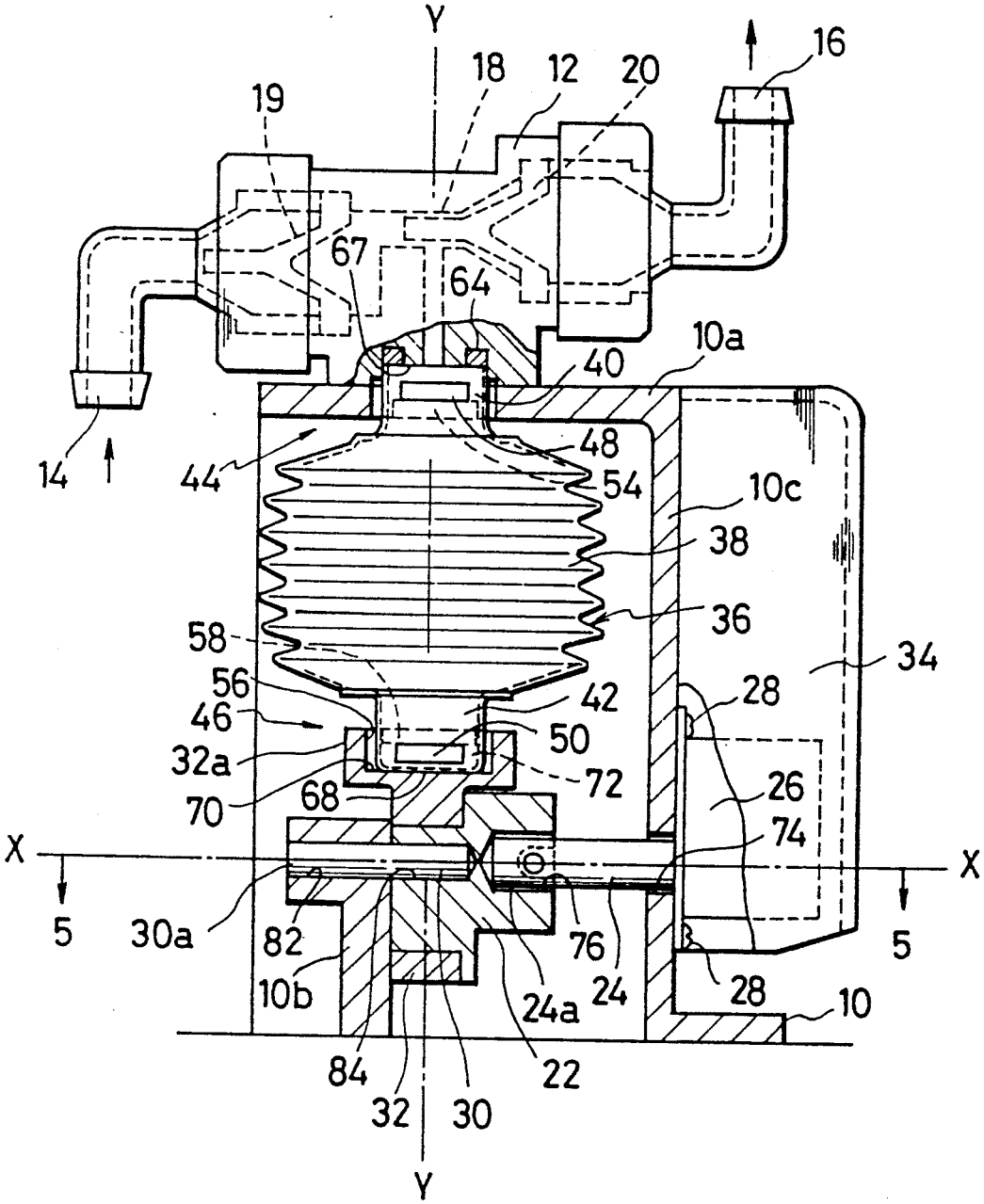
FIG. 1 is a fragmentary elevational sectional view showing an embodiment of the bellows pump according to the present invention.

Now, an embodiment of a bellows pump according to the invention will be described in detail with reference to the drawings.

Designated at 10 is a pump frame, having an upper frame portion 10*a*, the top of which is a pump head 12 having an inlet port 14 and a discharge port 16 is secured to by bolts (not shown). Both the ports 14 and 16 are connected via one-way check valves 19 and 20 to a flow path 18 as shown by broken lines, formed in the pump head 12 for pumping fluid such as water or chemical solution.

In a lower portion of the inner space of the pump frame 10 is disposed an eccentric cam member 22 having a horizontal axis X—X of rotation extending horizontally and transversely. The eccentric cam member 22, as shown in FIG. 1, has its opposite sides supported respectively by a motor shaft 24 of a drive motor 26 secured by bolts 28 to the right side wall of the frame 10 and by pin shaft 30 extending from a support frame portion 10*b* of the frame 10. With rotation of the cam member 22 caused by the drive motor 26 a reciprocating member 32 engaged at the lower end thereof with the eccentric cam member 22 is driven, causing a reciprocal motion of an upper connecting end portion 32*a* along a vertical axis Y-Y. The eccentric cam member 22 and reciprocating member 32 constitute a motion conversion mechanism for converting a rotational motion to a reciprocal motion. Designated at 34 is a casing for the drive motor 26.

Designated at 36 is a bellows, which includes a barrel-shaped bellows body 38 disposed along the vertical axis Y-Y and capable of elongation and contraction therealong, an upper section 40 constituting an open end having a communication hole 41 and a lower end section 42 constituting a closed end, the bellows body 38 and both sections 40 and 42 being integral with one another, and is provided between the pump head 12 and the reciprocating member 32.

The upper end section 40 is mounted by first mounting means 44 and communicated with the pump head 12. The lower end section 42 is mounted by a second mounting means 46 and coupled to the motion conversion mechanism via the second mounting means 46. With the operation of the motion conversion mechanism the bellows 36 is elongated and contracted along with the axis Y-Y, whereby fluid entering through the inlet port 14 is communicated with the bellows 36 through the valve 19, flow path 18 and communication hole 41, and is discharged from the discharge port 16 through the communication hole 41, flow path 18 and the other valve 20. In this way, pumping is effected.

For communicating the bellows 36 to the pump head 12 and coupling it to the bellows 36, the bellows 36 is mounted in the first and second mounting means 44 and 46 with the following mounting structure.

Figure 2:
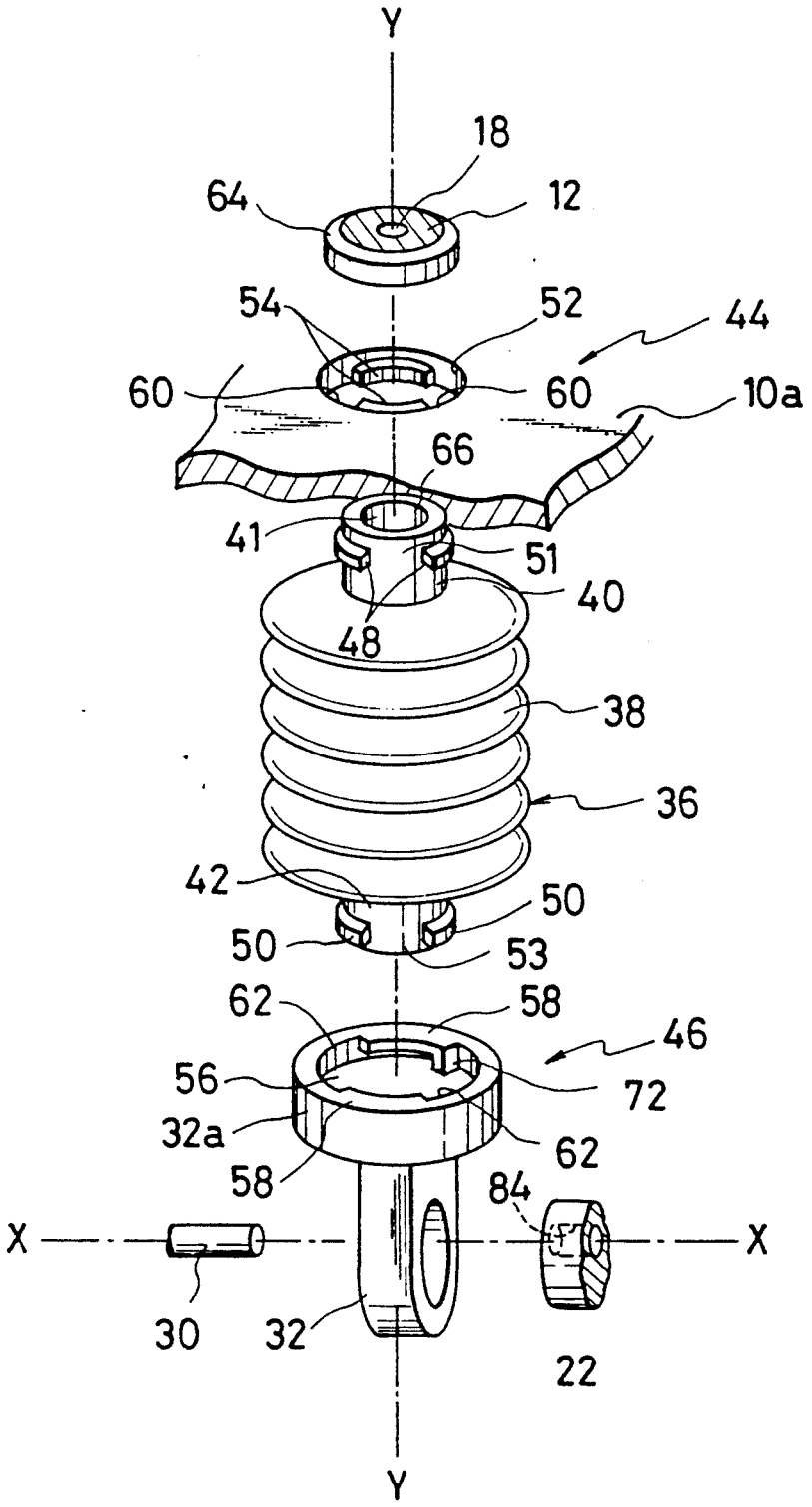
FIG. 2 is an exploded perspective view showing a removable mounting state of bellows in the bellows pump shown in FIG. 1.
Figure 3:
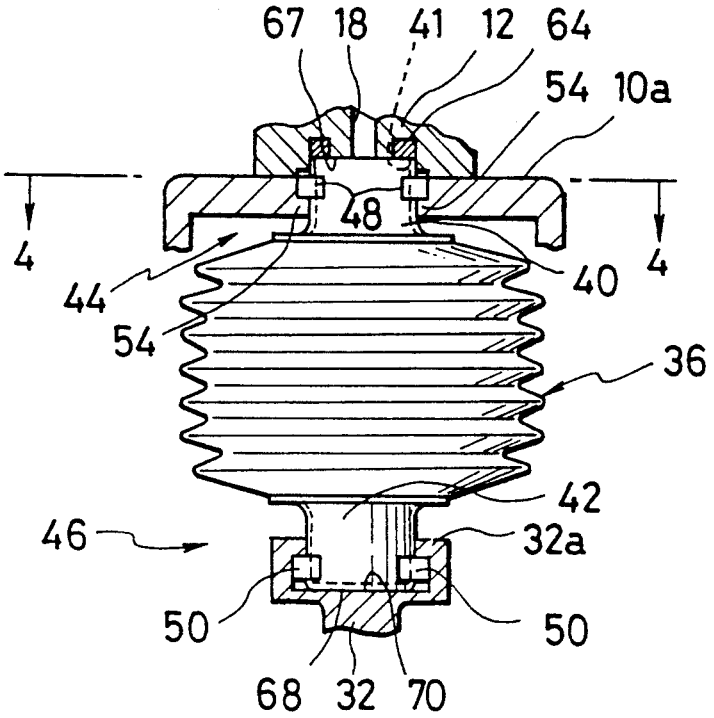
FIG. 3 is a fragmentary side view showing bellows and mounting portion thereof in the bellows pump shown in FIG. 1 looked from the left side of FIG. 1.

As shown in FIGS. 2 and 3, the outer periphery of the upper end section 40 of the bellows 36 is provided in a circumferential region with a pair of diametrically opposed integral projections or ridges 48. Likewise, the outer periphery of the lower end section 42 is provided in a circumferential region with a pair of diametrically opposed integral projections o ridges 50.

The remaining circumferential regions other than those provided with the projections 48 and 50 are formed with respective notches or cutouts 51 and 53.

The first mounting means 44 is further provided with a circular mounting through hole 52 open at the upper frame portion 10*a* of the frame 10, and a pair of diametrically opposed portions or ridges 54 projecting from the inner periphery of the mounting hole 52. The second mounting means 46, on the other hand, is further provided with a recess 56 formed at the connecting end portion 32*a* of the reciprocating member 32 and a pair of diametrically opposed projections or ridges 58 projecting from the inner periphery of the recess 56.

The remaining circumferential regions other than those provided with paired projections 54 and 58 are formed with respective notches or cutouts 60 and 62.

Figure 4:
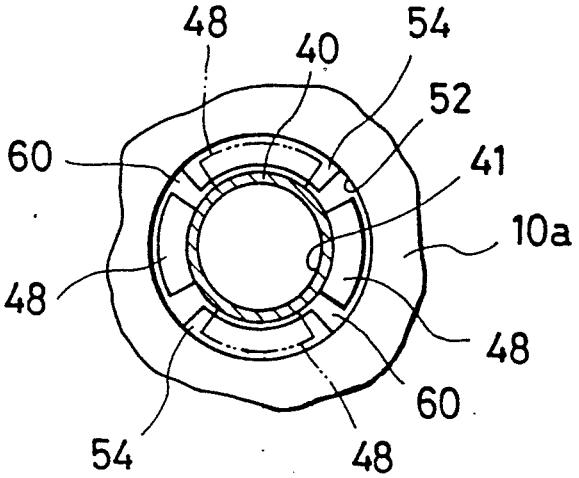
FIG. 4 is a fragmentary enlarged-scale view taken along line 4—4 in FIG. 3, showing the mounted state of an upper end section of the bellows.

The projections 48 on the upper end section 40 of the bellows 36 can be rotated with the rotation of the bellows 36 about the vertical axis Y-Y thereof from a non-engagement position as shown by solid lines in FIG. 4, at which they are located in the corresponding cutouts 60 of the upper frame section 10*a* to an engagement position shown by phantom lines in the same Figure, at which they are located to engage with the corresponding portions 54 of the upper frame path 10*a*. When the paired portions 48 are at the non-engagement position, the upper end section 40 of the bellows 36 can be removed or detached from the upper frame portion 10*a* for disengagement from the pump head 12. In the engagement position the upper end section 40 is restricted against its axial displacement and is coupled to the upper frame portion 10*a* for engagement with the pump head 12.

Designated at 64 is a seal member provided in the pump head 12. When the upper end section 40 is in the engagement position, the upper end edge 66 (FIG. 2) of the peripheral wall of the communication hole 41 of the upper end section 40 is in contact with the corresponding surface 67 of the pump head 12 via a seal member 64. This contact ensures engagement between the paired projections 48 and 54 without play to ensure reliable holding of the first mounting means 44. The paired projections 50 on the lower end section 42 of the bellows 36, likewise, can be rotated with the rotation of the bellows 26 about the vertical axis Y-Y thereof and with the same angle of rotation as that of the projections 48 of the upper end section 40 from a non-engagement position, at which they are located in the corresponding cutouts 62 of the connecting end portion 32*a* to an engagement position, at which they are located to engage with the corresponding projections 58 of the connecting end portion 32*a*.

In their non-engagement position, the lower end section 42 of the bellows 36 can be relatively displaced in the vertical direction Y-Y such as to permit removal of the bellows 36. In the engagement position, the lower end section 42 is restricted against vertical displacement and is fixed to the connecting end portion 32*a* such that the bellows 36 can be elongated and contracted. In the engagement position, the closed end surface of the lower end section 42 is in contact with the bottom surface 70 of the connecting end portion 32*a*, as shown in FIGS. 1 and 3. Thus, engagement between the paired projections 50 and 58 can be obtained without rattling to ensure reliable holding by the second mounting means 46.

At least either first or second mounting means 44 or 46, specifically the second mounting means 46 in this embodiment, is provided with a stopper 72 as stop means which can engage with the corresponding projection 50 of the lower end section 42 to restrict the bellows 36 against further rotation with the projection 50, thereby being positively brought to and held at the predetermined proper engagement position.

The stopper 72 is formed integral with one end of each projection 58 in the circumferential direction and engages with the projection 50 corresponding to the lower end section 42 in the engagement position, thus preventing the rotation of the bellows 36.

In the above construction, the bellows 36 can be mounted by coupling the upper and lower end sections 40 and 42 thereof to the upper frame portion 10*a* and the connecting end portion 32*a* respectively through the first and second mounting means 44 and 46. In the mounting operation, the upper end section 40 is inserted in the through hole 52 of the upper frame portion 10*a*, and the lower end section 42 is inserted in the recess 56 of the connecting end portion 32*a*. Both the sections 40 and 42 are rotated about the vertical axis Y-Y from the non-engagement position to the engagement position until the projection 50 is restricted by the corresponding stopper 72, i.e., until the upper and lower end sections 40 and 42 are brought to their predetermined proper engagement position. Also, the bellows 36 can be removed by turning it reversely such that both the sections 40 and 42 are turned from the engagement position to the non-engagement position. Since the first and second mounting means 44 and 46 are provided as above, the number of parts which have to be assembled for mounting the bellows 36 can be reduced to permit reduction of the number of steps and cost of the assembling operation. In addition, the bellows 36 can be mounted and removed easily and quickly even in the limited narrow space.

Figure 5:
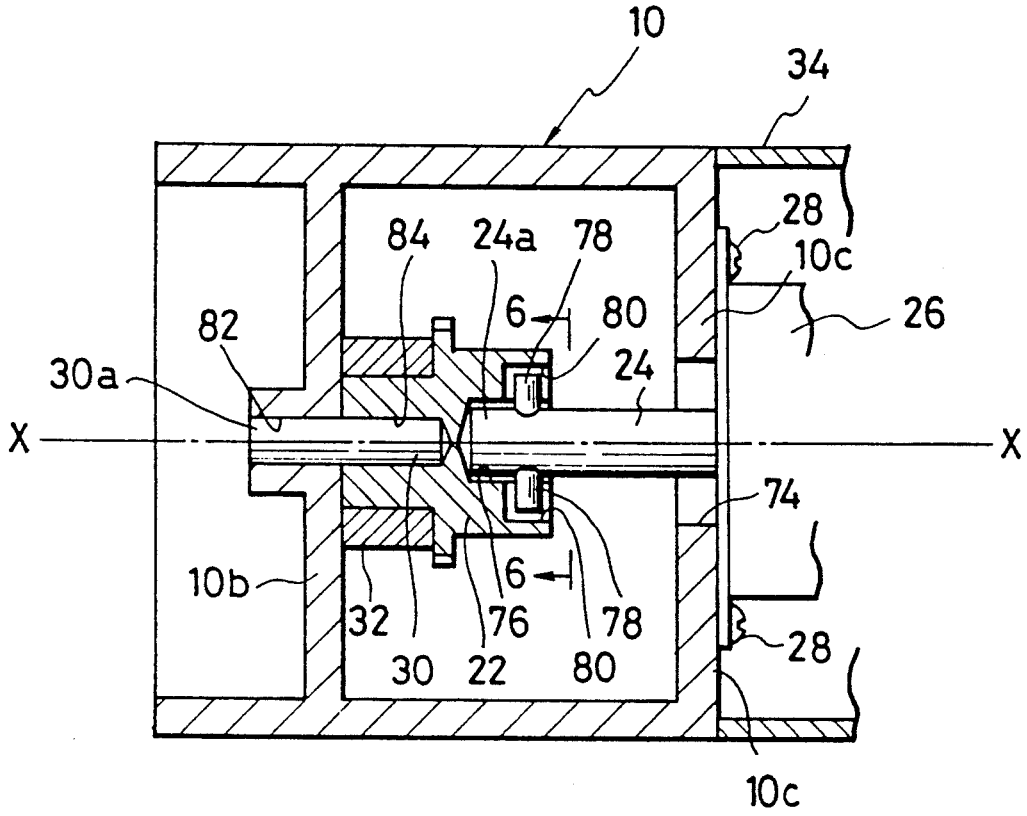
FIG. 5 is an enlarged-scale sectional view taken along line 5—5 in FIG. 1, showing particularly a rotational support structure portion.
Figure 6:
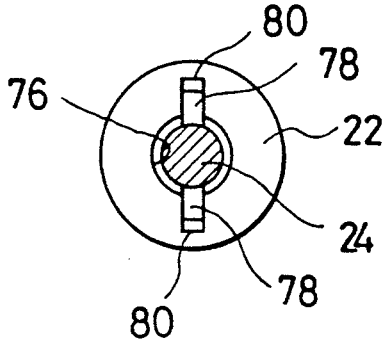
FIG. 6 is a fragmentary end view taken along line 6—6 in FIG. 5.

Now, the drive mechanism including the drive motor 26 will be described with reference to FIGS. 5 and 6.

The motor shaft 24 as drive shaft for driving the eccentric cam member 22 extends from the motor 26 along the horizontal axis X-X. A stem portion of the motor shaft 24 penetrates a hole 74 formed in the wall 10*c* of the frame 10. Since there is no bearing here, the motor shaft 24 extends in the form of a cantilever. The extended end 24*a* of the motor shaft 24 is inserted in a bore 76 formed in the eccentric cam member 22. The bore 76 has a diameter slightly greater than the outer diameter of the motor shaft 24, thus permitting slight lateral movement with respect to the axis X-X.

The extended end portion 24*a* is provided with a pair of pins 78 extending in a radial direction with respect to the axis X-X. These pins 78 are engaged in paired engagement grooves 80 formed in the peripheral wall of the bore 76 of the eccentric cam member 22. Thus, the motor shaft 24 and eccentric cam member 22 are rotated in unison with each other in the rotational direction. That is, loose coupling means is provided by the structure for engagement between paired pins 78 and engagement grooves 80 and the structure with the motor shaft 24 and bore 76 having different diameters.

The proximal end portion 30*a* of the pin shaft 30 on the side opposite the motor shaft 24 with respect to the eccentric cam member 22, is fixedly mounted in a mounting hole 82 formed in the support frame portion 10*b* and extends toward the extended end portion 24*a* of the motor shaft 24 in a state aligned thereto on and along the axis X-X. In this state, the pin shaft 30 is inserted in a support hole 84 of the eccentric cam member 22 and receives the eccentric cam member 22 so as to allow a free rotation of the member 22 along the axis X-X.

The frame 10 is made of a moldable synthetic resin, and the pin shaft 30, which is made of a metal, is made integral at the time of manufacture with the support frame portion 10*b* of the frame 10 by insert molding.

With the above construction, in which the motor shaft 24 extending from the drive motor 26 is coupled to one side of the eccentric cam member 22 for driving the same, and also in which the pin shaft 30 with the proximal end portion 30*a* thereof secured to the support frame portion 10*b* and projecting in the horizontal axis X-X supports the eccentric cam member 22 on the other side thereof for rotation, the load accompanying the elongation and contraction of the bellows 36 in the vertical axis Y-Y with respect to the horizontal axis X-X of rotation of the eccentric cam member 22, i.e., commonly called overhand load, is received by the pin shaft 30 to suppress the overhand load on the motor shaft 24, thus permitting durability improvement and manufacturing cost reduction.

Further, the structure, in which the pin shaft 28 and motor shaft 24 are provided on the respective sides of the eccentric cam member 22, permits ready and quick operations of assembling and disassembling the individual constituent parts and improvement of the operation control property. Further, with the structure, which does not require any set screws or the like for securing the eccentric cam member 22 to the motor shaft 24, there is no possibility of causing damage to female threads with set screws in the case where the eccentric cam member 22 is made of a resin, which contributes to the improvement of the operation control property noted above.

The torque of the eccentric cam member 22 is transmitted due to the engagement between the engagement grooves 80 and corresponding pins 78 of the motor shaft 24, and there is no need of securing the insertion bore 76 of the eccentric cam member 22 and extended end portion 24*a* of the motor shaft 24 to each other. With this loose coupling means it is thus possible to eliminate, for instance, the possibility of application of the overhand load to the motor shaft 24 due to slight departure from the axial alignment of the motor shaft 24 and pin shaft 30.

While the invention has been described in conjunction with an embodiment thereof, the embodiment is by no means limitative, and various changes and modifications may be made without altering the subject matter of the invention.

What is claimed is:

1. A bellows pump comprising:

a pump frame;

a pump head mounted on an upper frame portion of said pump frame and having an inlet port, a discharge port and a flow path for pumping fluid communicating with said inlet and discharge ports via respective valves;

a drive motor mounted on said pump frame;

a drive shaft driven by said drive motor;

an eccentric cam member for producing eccentric rotation with the rotation of said drive shaft;

a reciprocating member having a connecting end portion for producing a vertical reciprocal motion with the eccentric rotation of said eccentric cam member;

a bellows disposed vertically in said pump frame and having a lower and an upper end sections, said bellows being capable of being elongated and contracted along a vertical line, said upper end section having a communication hole communicating the inside of said bellows with said flow path of said pump head;

first mounting means for connecting said upper end second mounting means for connecting said lower end section of said bellows to said connecting end of said reciprocating member;

said first mounting means including a first projection formed on and along a circumferential region of the outer periphery of said upper end section of said bellows, a first notch formed in the remaining circumferential region of said outer periphery, a mounting hole penetrating said upper frame portion of said pump frame and permitting insertion of said upper end section of said bellows, a second projection formed on and along a circumferential region of the inner periphery of said mounting hole and a second notch formed in the remaining circumferential region of said inner periphery, said bellows being capable of being rotated with said upper end section inserted in said mounting hole about said vertical axis between a first engagement position, at which said first and second projections engage each other, and a first non-engagement position, at which said first projection faces said second notch, said upper end section being fixedly mounted in said upper frame portion of said pump frame when said bellows is at said first engagement position, said upper end section being capable of being removed from said upper frame portion of said pump frame when said bellows is at said first non-engagement position;

said second mounting means including a third projection formed on and along a circumferential region of the outer periphery of said lower end section of said bellows, a third notch formed in the remaining circumferential region of said outer periphery, a recess formed in said connecting end portion of said reciprocating member and capable of receiving said lower end portion of said bellows, a fourth projection formed on and along a circumferential region of the inner periphery of said recess, a fourth notch formed in the remaining region of said inner periphery, said bellows being capable of being rotated with said lower end section inserted in said recess about said vertical axis between a second engagement position, at which said third and fourth projections engage with each other, and at a second non-engagement position, at which said third projection faces said fourth notch, said lower end section being fixedly mounted in said connecting end portion of said reciprocating member when said bellows is at said second engagement position, said lower end section being capable of being removed from said connecting section when said bellows is at said second non-engagement position, at least one of said first and second mounting means being provided with stop means for restricting the rotation of said bellows about said vertical axis.

2. The bellows pump according to claim 1, wherein said stop means is a stopper provided such that it is continuous to one end of said fourth projection in the circumferential direction thereof.

3. The bellows pump according to claim 1, wherein said upper end section of said bellows has an upper end edge around said communication hole, and said upper end edge is in contact via seal means with the corresponding end face of said pump head, thereby ensuring reliable holding between said upper end section and said upper frame portion at said first engagement position.

4. The bellows pump according to claim 1, wherein said lower end section of said bellows has a closed end surface, and said recess of said reciprocating member has a bottom surface, and said closed end surface being in contact with said bottom surface at said second engagement position, thereby ensuring reliable holding between said end section and said reciprocating member at said second engagement position.

5. The bellows pump according to claim 1, wherein said first to fourth projections each consist of a pair of projections diametrically facing each other.

6. The bellows pump according to claim 1, wherein said drive shaft consists of a motor shaft extending in a horizontal direction from said drive motor toward said eccentric cam member and having a horizontal axis of rotation, and which further comprises:

loose coupling means for causing rotation of said extended end portion of said motor shaft and said eccentric cam member in unison with each other in the direction of rotation while permitting slight relative movement of the motor shaft and the eccentric cam member in lateral direction with respect to said horizontal axis of rotation;

a pin shaft having a proximal portion fixed to a support frame portion of said pump frame and horizontally extending toward said extended end portion of said motor shaft in a state aligned to said horizontal axis of rotation; and a support hole formed in said eccentric cam member for receiving said pin shaft to permit rotation of said eccentric cam member about said pin shaft.

7. The bellows pump according to claim 6, wherein said loose coupling means includes an insertion hole formed in said eccentric cam member and receiving the extended end portion of said motor shaft, an engagement pin radially projecting from said extended end portion, and an engagement groove formed in the peripheral wall of said insertion hole in said eccentric cam member for engagement with said engagement pin, the inner diameter of said insertion hole being greater than the outer diameter of said extended end portion of said motor shaft.

8. The bellows pump according to claim 6, wherein said support frame portion is made of a moldable synthetic resin, said pin shaft is made of a metal, and said pin shaft is fixed to said support frame portion by insert molding.

* * * * *

UNITED STATES PATENT AND TRADEMARK OFFICE

CERTIFICATE OF CORRECTION

PATENT NO. : 5,165,866

DATED : November 24, 1992

INVENTOR(S) : Masayuki Kato

It is certified that error appears in the above-identified patent and that said Letters Patent is hereby corrected as shown below:

Claim 1, column 9, lines 26-28, "second mounting means for connecting said lower end section of said bellows to said connecting end of said reciprocating member;" should be separated and indented as a new paragraph.

Claim 1, column 9, line 25, "section of said bellows to said pump head; and" should be inserted after "end".

Signed and Sealed this

Twenty-third Day of November, 1993

*Attest:*

Bruce Lehman

BRUCE LEHMAN

*Attesting Officer*

*Commissioner of Patents and Trademarks*